United States Patent [19]

Schaeffel, Jr. et al.

[11] Patent Number: 4,588,146

[45] Date of Patent: May 13, 1986

[54] BIAXIAL FOLDING LEVER WING

[75] Inventors: John A. Schaeffel, Jr., Cullman; Jimmy M. Madderra; Ronald L. West, both of Huntsville, all of Ala.

[73] Assignee: The United States of America as represented by the Secretary of the Army, Washington, D.C.

[21] Appl. No.: 594,658

[22] Filed: Mar. 29, 1984

[51] Int. Cl.[4] ..... F42B 13/32

[52] U.S. Cl. ..... 244/3.27; 244/3.28; 244/3.29

[58] Field of Search ..... 244/3.24, 3.25, 3.27, 244/3.28, 3.29, 49

[56] References Cited

U.S. PATENT DOCUMENTS 3,918,664 11/1975 Grosswendt ..... 244/3.28

4,336,914 6/1982 Thomson ..... 244/3.27

FOREIGN PATENT DOCUMENTS 505361 10/1969 Switzerland ..... 244/3.27

*Primary Examiner*—Deborah L. Kyle

*Assistant Examiner*—Michael J. Carone

*Attorney, Agent, or Firm*—Anthony T. Lane; Robert P. Gibson; Harold W. Hilton

[57] ABSTRACT

This invention disclosure describes a wing concept which can be folded along two axes. In the folded configuration, the semi-span of the wing lies parallel to the centerline of the missile fuselage. At deployment, the wing rotates about an axis parallel to the missile centerline. A second rotation follows when the wing's semi-span is made perpendicular to the missile's centerline. Finally the wing is locked into place and the deployed flight configuration is assumed.

5 Claims, 17 Drawing Figures

BIAXIAL FOLDING LEVER WING

DEDICATORY CLAUSE

The invention described herein may be manufactured, used, and licensed by or for the Government for governmental purposes without the payment to us of any royalties thereon.

BACKGROUND OF THE INVENTION

In recent years, the Army has experimented with a number of different wing deployment concepts for cruise type missiles, such as the FOG-M. The objective of having a folding wing is to achieve a low missile packing volume in a launcher or packing container prior to launch. Prior to or at launch, the wings are deployed to achieve a flight configuration. The Army has experimented with cloth, forward folding, aft folding and rotating wings.

The wings of the present invention may be folded along two different axis to achieve a low missile packing volume.

The wings are capable of being deployed very fast (less than 600 ms) and are self locking and require no special detents.

The deployment mechanism is rather simple, and the structure is aerodynamically clean with no visible external deployment hardware after the wing is deployed.

SUMMARY OF THE INVENTION

A plurality of wings are secured to a missile and are adapted to be folded along two axes. The missile includes a plurality of extending members to which the wings are pivotally secured by means of a swivel assembly. Extension springs, attached to the outer end of the wing and to a centerguide of the swivel assembly, biases the wings to the fully extended or deployed position subsequent to the swivel assembly rotating the wings from a first folded position to a second folded position.

DESCRIPTION OF THE PREFERRED EMBODIMENT

Figure 1:
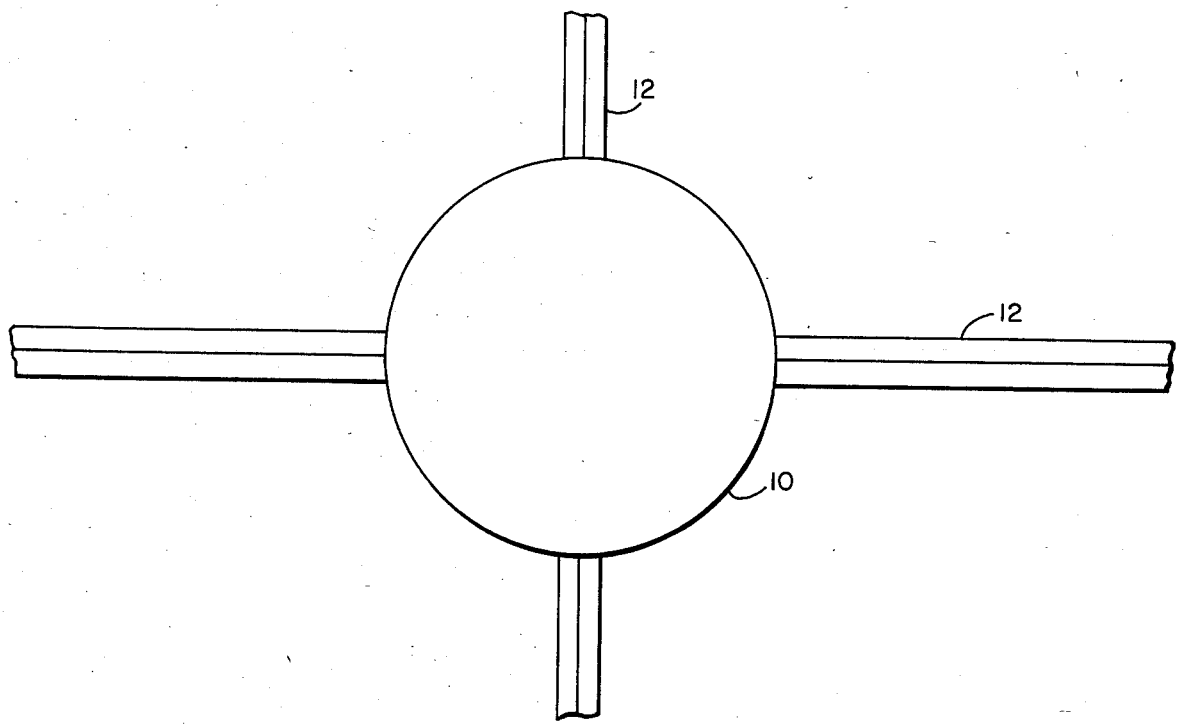
FIG. 1 is a rear view of a missile having a wing assembly of the present invention in deployed position.
Figure 2:
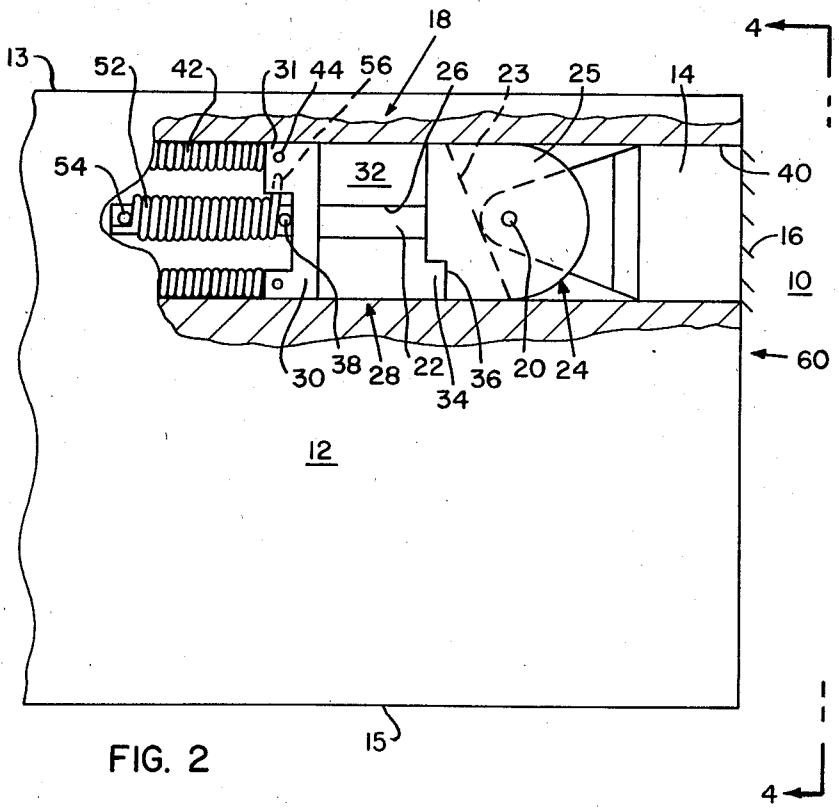
FIG. 2 is an elevational view of a wing, partially in section, illustrating the position of the elements of the wing assembly when the wing is deployed as in FIG. 1.
Figure 3:
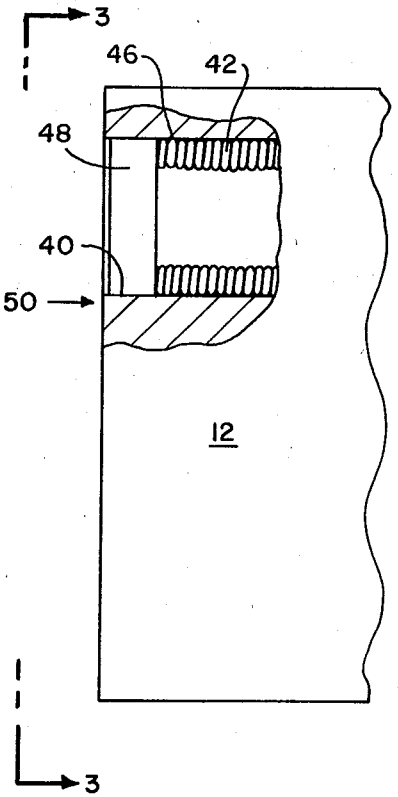
FIG. 3 is an elevational view taken along line 3—3, of FIG. 2.
Figure 3:
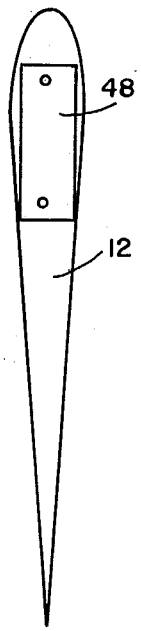

FIG. 1 illustrates a missile 10 having the wings 12 of the present invention in a deployed configuration. As seen in FIG. 2, wings 12 are provided with a leading edge 13 and trailing edge 15. wing root 14 is secured to the body 16 of missile 10 and extends therefrom. Wing root 14 is secured to a swivel assembly 18 by a roll pin 20. Swivel assembly 18 includes a shaft 22 having a flat end member 24 thereon. Shaft 22 extends through an opening 26 of a center guide member 28. Member 28 includes a shoulder 30 having a pair of elements 32 extending therefrom. Elements 32 are provided with stepped surfaces 34 thereon for mating with a pair of stepped surfaces 36 on flat end member 24. End member 24 is formed with a groove 21 (FIGS. 5,8,9,12 and 14) having an angled surface 23 (FIGS. 2,6,13 and 14) therein. The groove provides a pair of extending portions 25 on member 24 (FIG. 14). The centerguide member is fastened to the swivel assembly by a roll pin 38 and positions the wing relative to the swivel during the folding operation. A cavity 40 is provided in wing 12 to receive the wing root 14, swivel assembly 18 and centerguide 28. Extension springs 42 are attached to the centerguide by pins 44 which extend through openings 45 (FIGS. 15 and 16) on a pair of members 31 which extend from shoulder 30 in a direction opposite the extending members 32. The other end 46 of springs 42 are secured to a wing cap 48 on the outboard end 50 of wing 12.

A torsion spring 52 is mounted on shaft 22 by a roll pin 54 and to the centerguide 28 by the extended end of the spring which forms a grip 56. The function of the torsion spring is to rotate the wing 12 relative to the wing root 14 during deployment.

Figure 17:
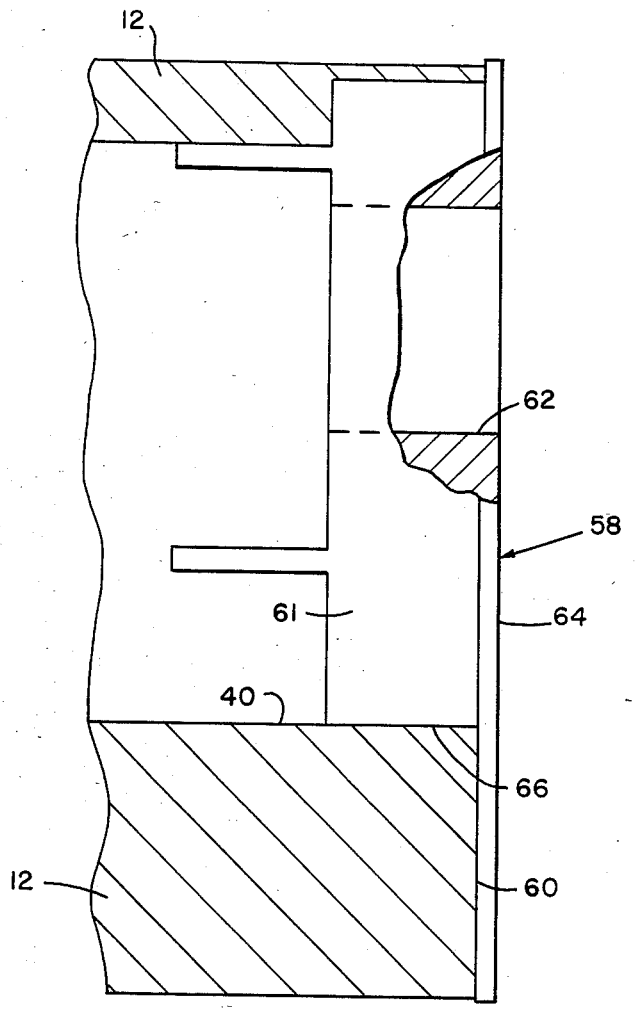
FIG. 17 is a plan view, partially in section, of a wing cap or socket mounted on the inboard end of the wing.

A wing socket 58 (FIG. 17) may be secured to the inboard end 60 of wing 12 to receive the swivel assembly 18 therein. The wing socket 58 includes a body portion 60 having an opening 62 through which the flat end member 24 of swivel member 18 extends for the secured relation with root member 14. A flanged portion 64 closes wing cavity 40. Wing socket 58 is more clearly shown in FIG. 17. If wing socket 58 is used, opening 40 of wing 12 is enlarged to abut against a shoulder 66 of wing socket 58.

Figure 13:
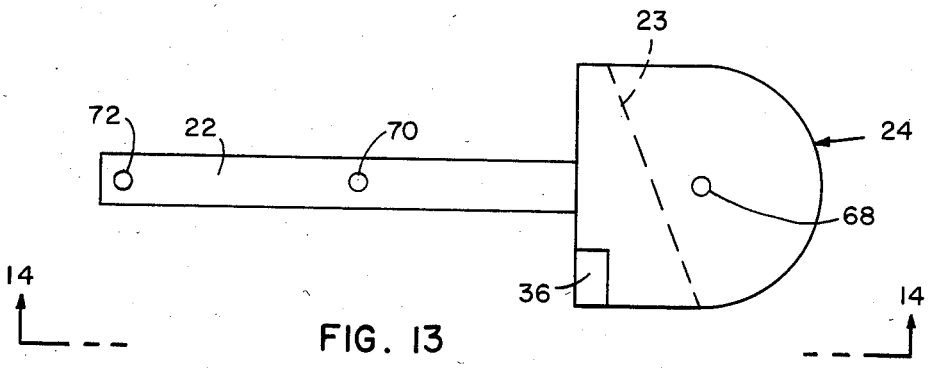
FIG. 13 is an elevational view of the swivel member for pivotally mounting the wing to the missile.
Figure 14:
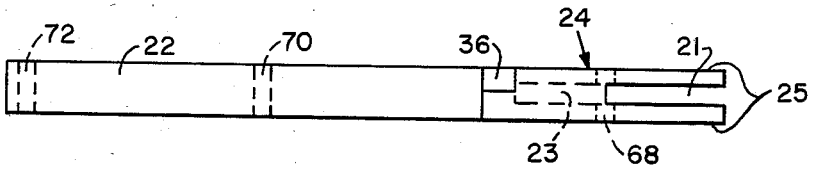
FIG. 14 is a view along line 14—14 of FIG. 13.
Figure 15:
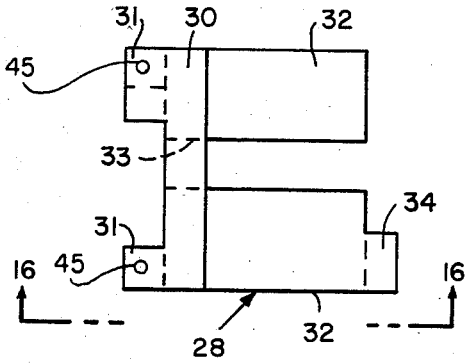
FIG. 15 is an elevational view of the centerguide member in which the swivel of FIG. 13 is mounted.
Figure 16:
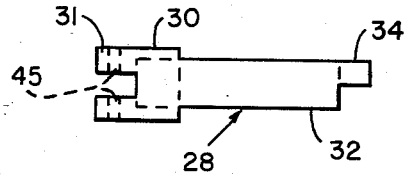
FIG. 16 is a view along line 16—16 of FIG. 15.

FIGS. 13 and 14 are detailed views of the swivel member and FIGS. 15 and 16 are detailed views of the centerguide member which together make up swivel assembly 28. As seen in FIG. 13 the swivel includes an end member 24 having a shaft 22 extending therefrom. The shaft is provided with openings 68, 70 and 72 (FIG. 13) to receive roll pins 20, 38 and 54 (FIGS. 2 and 6), respectively. Stop member 36 is positioned on the lower portion of member 24. A groove 21 is formed between extending portions 25.

As seen in FIGS. 15 and 16, centerguide member 28 includes a shoulder 30 having a pair of members 32 extending thereform. An opening 33 is provided in shoulder 30 to receive shaft 22 of the swivel. A second pair of members 31 extend from shoulder 30 in a direction opposite to members 32. Members 31 are provided with openings 45 therein to receive pins 44 for securing springs 42 thereto. Stop member 34 is provided on the lower surface of member 32.

Figure 9:
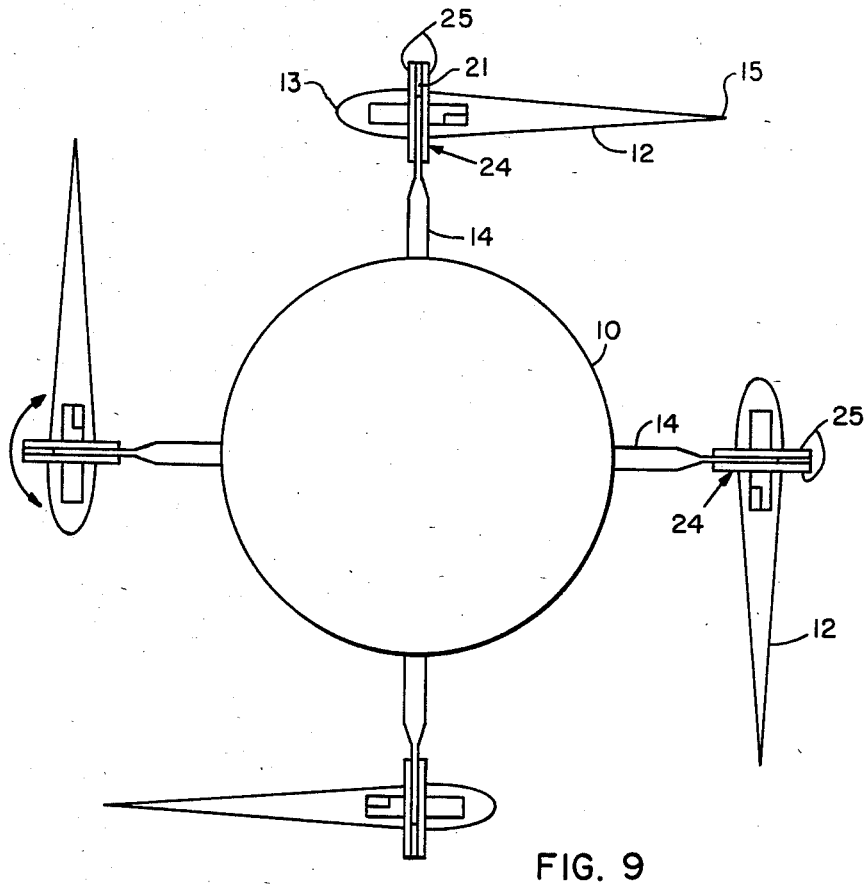
FIG. 9 is an elevational rear view of the wings in a second folded position.
Figure 4:
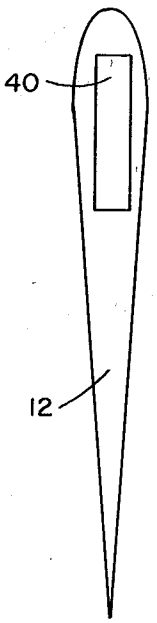
FIG. 4 is an elevational view taken along line 4—4 of FIG. 2.
Figure 5:
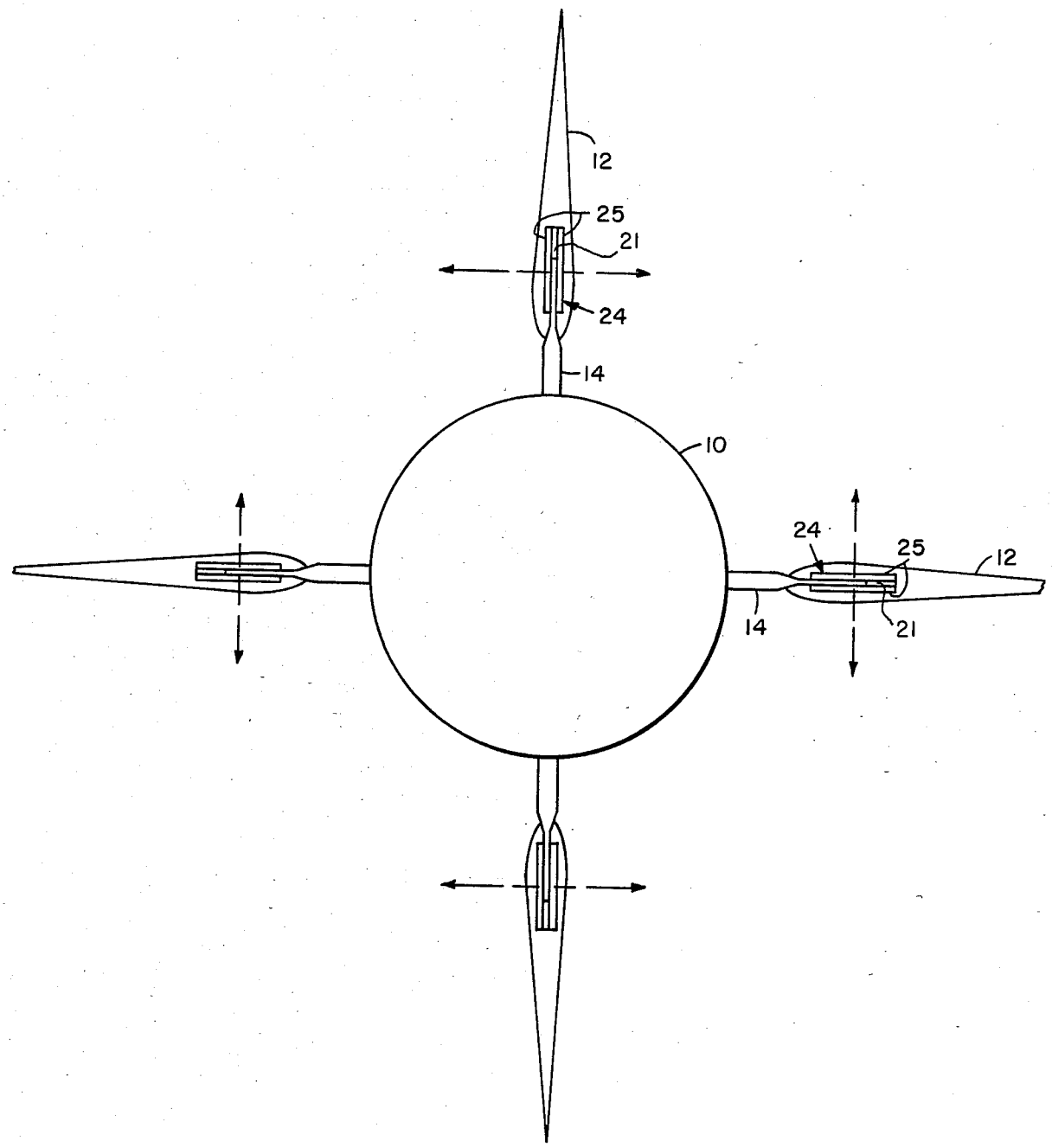
FIG. 5 is an aft elevational view of the wings in a first folded position.
Figure 8:
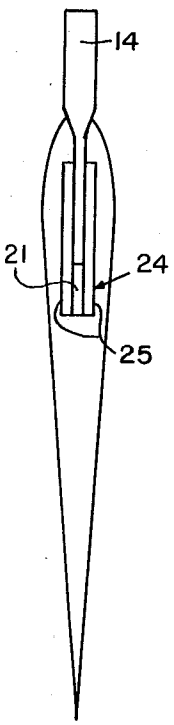
FIG. 8 is an elevational view along line 8—8 of FIG. 6.
Figure 6:
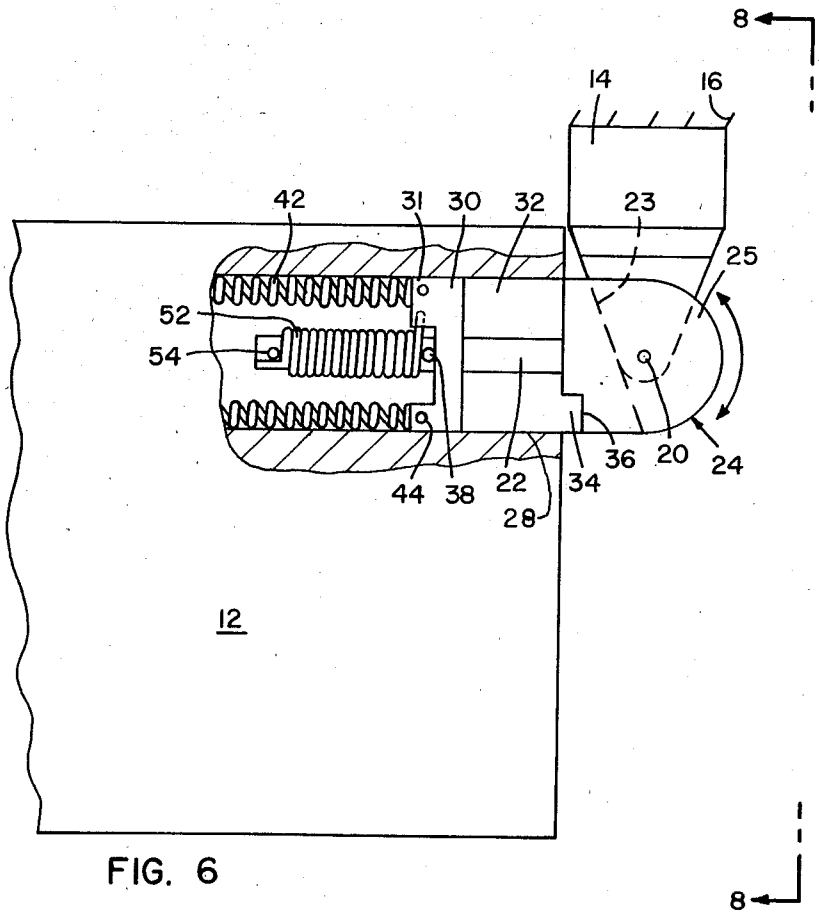
FIG. 6 is an elevational view, partially in section, illustrating the position of the elements of the wing assembly when the wing is in a first folded position as shown in FIG. 5.
Figure 7:
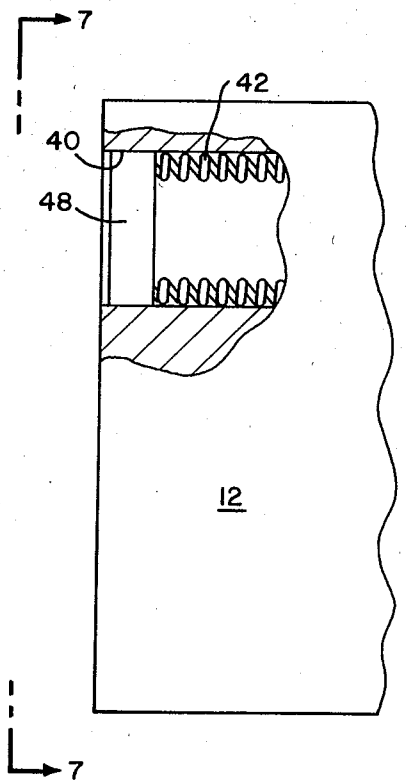
FIG. 7 is an elevational view along line 7—7 of FIG. 6.
Figure 7:
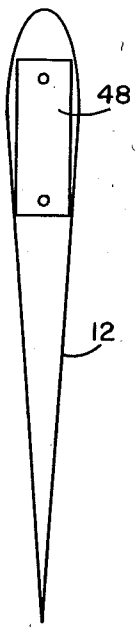
Figure 12:
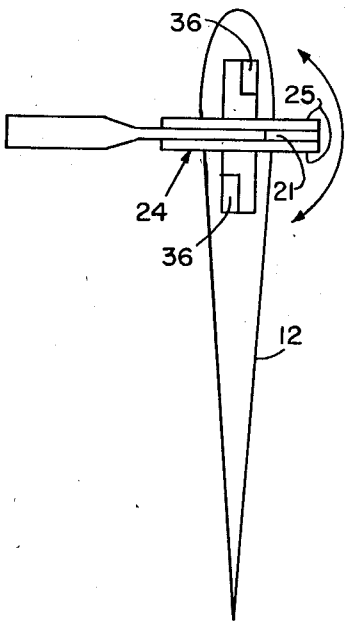
FIG. 12 is an elevational view taken along line 12—12 of FIG. 10.
Figure 10:
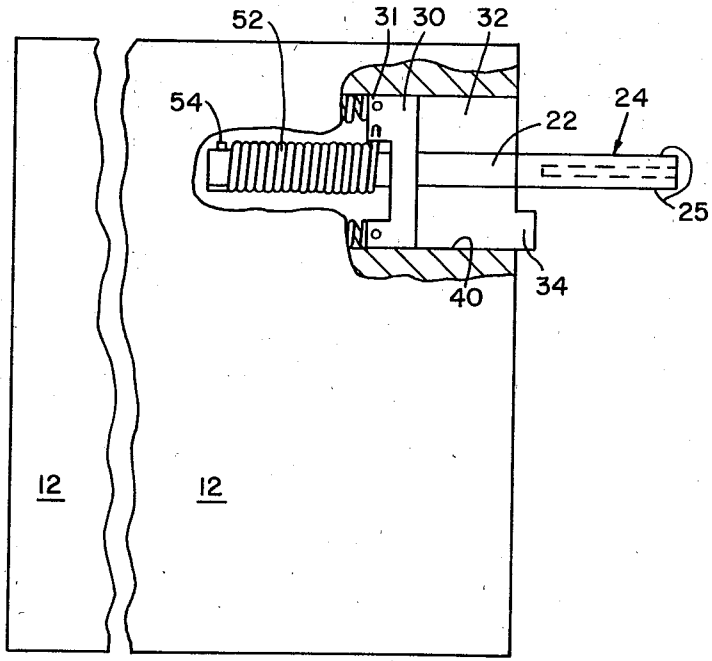
FIG. 10 is an elevatinal view, partially in section, illustrating the position of the elements of the wing assembly when the wing is in the second folded position as shown in FIG. 9.
Figure 11:
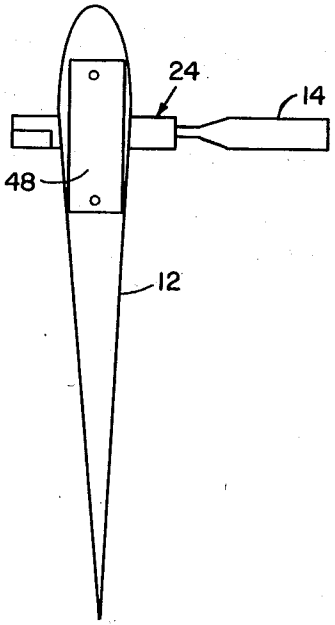
FIG. 11 is an elevational view taken along line 11—11 of FIG. 10

Operation Cycle of Invention:

The following description gives the details necesary for folding the wing. During deployment the steps given are performed in reverse. FIG. 1 illustrates the wings deployed using an aft view looking forward. As indicated the aerodynamic configuration is clean since all of the mechanism necessary for folding the wing is internally located. FIG. 2 is an internal view of the deployed wing. The wing 12 is held onto the wing root 14 by extension springs 42. To fold the wing, an operator pulls the wing straight off the root until the roll pin 20 clears the inboard edge 60 of the wing. The wing is then rotated forward (in this particular case) by applying a force on the wing to cause the swivel member 24 to rotate relative to the root about the roll pin 20. FIG. 5 indicates the forward folded wing thus described. The axis of rotation is also indicated. FIG. 6 indicates this new configuration. In FIG. 6 one should note the extended springs 42 and the position of the wing root 14 relative to the swivel member 24. The axis of rotation is also given in FIG. 6. One should also note that the surfaces 34 and 36 are engaged to position the wing 12 relative to the root 14 and the missile fuselage. The next operation in folding the wing is to rotate it by application of a torque such that the centerguide member 28 is rotated relative to the swivel member 24. This operation will disengage the stops 34 and 36 on the centerguide and swivel member 24, respectively. Application of the torque counters the moment generated by the torsion spring 52. FIG. 9 illustrates the final folded configuration. If desired the wing may be folded against the fuselage. FIGS. 10, 11 and 12 indicate the final folded configuration. The orientation of the fuselage relative to the wing root is shown in FIG. 9.

Typically, a missile would have folded wings as depicted and reside in a launcher whose walls would restrain the wings from deploying. It is also possible that a cable and cutter wrapped around the wings in the folded position would restrain them from deploying. For the following description of deployment, it will be assumed that wings are restrained from deploying by the walls of the launcher. At launch, the restraint force is absent and the torsion spring 52 shown in FIG. 10 applies a moment on the centerguide member 30 to rotate the wing 12 relative to the swivel member 24 from a second folded position to a first folded position. In the second folded position the plane containing the semi-span (one half of each wing, the complete wing being opposing semi-spans on opposite sides of the missile body) and chord of the wing was parallel to the centerline of the missile body. In the first folded position the chord of the wing is perpendicular to the missile centerline and the leading edge 13 of the wing is adjacent the missile body. Rotation continues until the stop 34 on the centerguide 28 engages the stop 36 of swivel member 24. The wing then assumes the configuration shown in FIG. 6. At this point the swivel member 24 is free to enter the wing cavity 40. The extension springs 42 pull the centerguide member 28 into the wing socket until the edge of the root 14 engages the inboard surface of the wing. The edge of the root now acts as a lever. As shown in FIG. 6 the extension springs 42 are acting to pull the swivel member 24 into the wing socket. The wing root 14 resists this motion by the force of interaction between the inboard surface of the wing and the engaged surface of the wing root 14. This generates a moment about the roll pin 20, and rotates the wing relative to the wing root. After the wing root is lined up with the wing socket (wing has rotated 90°) the extension springs pull the root into the wing socket and the configuration shown in FIGS. 1 and 2 assumed. The wing is not free to move since the springs prevent disengagement of the wing root from the socket unless an external force is applied.

We claim:

1. A biaxial folding lever wing assembly including a plurality of wings each having a cavity therein and disposed for folded relation on a missile body prior to launch of the missile and for extended relation from said missile body responsive to launch thereof comprising:

a. swivel means coacting with the body of said missile and said wings so that the plane containing the semi-spans and chord of said wing is rotated from a second folded position parallel to the centerline of said missile body to a first folded position parallel to the centerline of said missile body, said first position being defined as a position wherein said chord of said wing is normal to the centerline of said body and the leading edge of said wing is adjacent said body;

b. first biasing means for extending said wings so that the semi-spans of said wings are normal to said body of said missile; and, c. said swivel means including a plurality of wing root members secured to said body and extending therefrom and a swivel assembly rotatably secured to said wing root members, said swivel assembly and said wing root members disposed for positioning into said wing cavity responsive to deployment to said extended position, said swivel assembly including a flat end member having a shaft extending thereform, said flat end member disposed for the rotatably secured relation with said wing root members, said swivel assembly further including a centerguide member rotatably secured to said shaft for rotation thereon, and second biasing means carried on said shaft for rotating said flat end member and said wing from said second position to said first position; and, wherein said centerguide member including a shoulder having a first pair of members extending therefrom, one of said first pair of members provided with a stop for engaging said flat end member when said wings are in said first postion.

2. A biaxial folding lever wing assembly as in claim 1 wherein said centerguide member includes a second pair of members thereon, extending in a direction opposite the extending direction of said first pair of members.

3. A biaxial folding lever wing assembly as in claim 2 wherein said first biasing means is a pair of tension springs having a first end secured to the second pair of said extending members of said centerguide member, said wing including an outboard surface having the second end of said tension springs secured thereto.

4. A biaxial folding lever wing assembly as in claim 3 wherein second biasing means is a torsion spring secured on said shaft in biased relation with said centerguide member.

5. A biaxial folded lever wing assembly as in claim 4 wherein said plurality of wings is comprised of four wings spaced substantially equally around said missile body.

* * * * *